US005898977A

United States Patent [19]

Muir

[11] Patent Number: 5,898,977

[45] Date of Patent: May 4, 1999

[54] NON-HANDED IN-LINE WINDOW SUPPORTING BRACKET

[75] Inventor: Malcolm Muir, Honeoye Falls, N.Y.

[73] Assignee: Advantage Manufacturing Corp., Inc., Victor, N.Y.

[21] Appl. No.: 08/936,981

[22] Filed: Sep. 25, 1997

[51] Int. Cl.[6] ..... E05D 15/00; E05D 15/32

[52] U.S. Cl. ..... 16/363; 16/366; 16/387; 16/370; 16/341; 49/246

[58] Field of Search ..... 16/361–366, 370, 16/371, 341, 346, 347, 374, 368, 369, 228; 49/246, 247, 253; 5/13; 403/161, 150, 154

[56] References Cited

U.S. PATENT DOCUMENTS

| | | | |
|---|---|---|---|
| 1,596,470 | 8/1926 | Way et al. | 16/386 |
| 2,784,459 | 3/1957 | Anderberg et al. . | |
| 3,345,777 | 10/1967 | Anderberg et al. . | |
| 3,908,477 | 9/1975 | Teske et al. | 403/154 |
| 4,364,201 | 12/1982 | Taylor | 49/248 |
| 4,571,776 | 2/1986 | Taylor | 16/339 |
| 4,674,149 | 6/1987 | Vetter | 16/341 |
| 4,689,852 | 9/1987 | Buckley . | |
| 4,718,144 | 1/1988 | Buckley . | |
| 4,930,185 | 6/1990 | Hutton | 16/325 |
| 5,255,471 | 10/1993 | Shaw et al. | 16/370 |

*Primary Examiner*—Chuck Y. Mah
*Attorney, Agent, or Firm*—Cumpston & Shaw

[57] ABSTRACT

A supporting bracket for windows which can be used on any side of a window and which can be mounted using existing central mount installation tooling is disclosed. The supporting bracket uses dual sided containment of the vent bar end for preventing sash play and uses camming surfaces to allow for immediate sash pull in which prevents weather-strip problems and prevents the supporting bracket from binding during an opening operation. In some embodiments, an end cap engages opposite sides of a symmetric vent bar end. In another embodiment, a pin attached to the vent bar is engaged on opposite sides by a track formed within the main track of the supporting bracket. In all embodiments, the vent bar and the link pivotally connecting the vent bar to the track are prevented from moving in a direction opposite the direction of opening during an opening operation. The arms of the supporting bracket may have fully rounded edges for preventing binding between adjacent arms during load. Also, the vent bar end and corresponding structure for dual sided containment in each embodiment are symmetrically shaped so that the supporting bracket may be utilized on any side of a window.

21 Claims, 12 Drawing Sheets

FIG. 9A
(PRIOR ART)
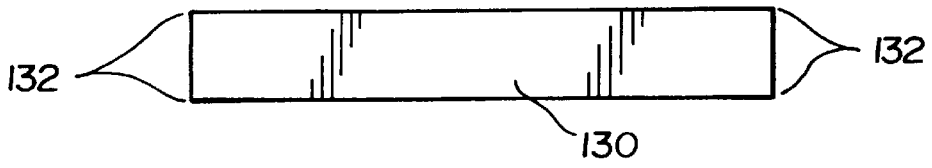
FIG. 9B
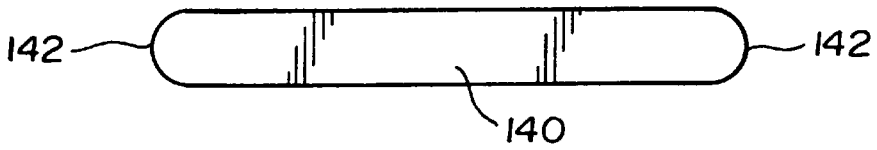
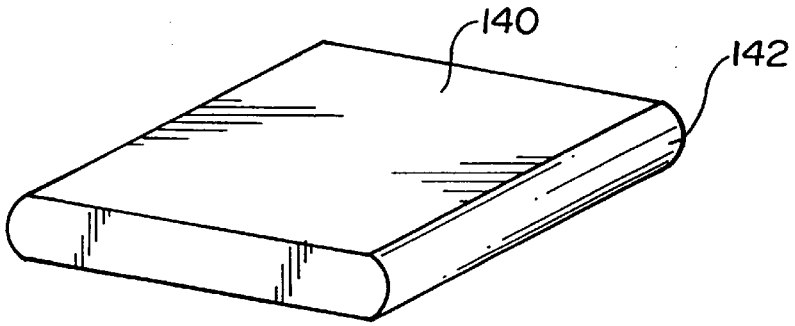
FIG. 9C

NON-HANDED IN-LINE WINDOW SUPPORTING BRACKET

FIELD OF THE INVENTION

The present invention relates to supporting brackets for windows which are arranged to support a window for pivotal movement about either a vertical or a horizontal axis. More particularly, the present invention relates to such a supporting bracket which can be used on any side of a window and which can be mounted using existing central mount installation.

BACKGROUND OF THE INVENTION

Supporting brackets of the type disclosed in the present invention are adapted to be employed for the support of casement type windows or projection type windows, that is, for the support of windows to permit their pivotal movement about a vertical axis or a horizontal axis, and are also adapted to be connected between a conventional window frame and window sash, whether these structures be formed of metal, wood, PVC, or other structural material. The brackets are typically arranged to cause the pivotal axis of the window to move to and from the window frame so that when the window is open, both surfaces are accessible from the inner side of the window.

U.S. Pat. No. 3,345,777 to Anderberg et al discloses a supporting bracket which can be used on either the left or right hand side of a window. In actual practice, however, the axes of the various pivot pins are purposely misaligned so that the vent bar is intended to occupy a position parallel to, but laterally offset from, the median line of the track, as is more clearly shown in U.S. Pat. No. 2,784,459, also to Anderberg et al. The supporting bracket is disclosed as capable of occupying either one of two such offset positions. This enables the supporting bracket to be mounted at either end of a window frame and sash without requiring the manufacture of "right" and "left" pairs. By disposing the vent bar in a laterally offset position, the various pivotal axes are offset sufficiently that the bar moves freely and easily from its offset superposed position to its various angular positions.

Although the supporting bracket of Anderberg et al may be used on either side of a window, it must be mounted with special notice taken as to the proper misalignment of the vent bar with respect to the track. A supplier of such supporting brackets must provide a manufacturer of window frames with detailed offsetting specifications for locating a bracket with respect to a frame. Specially fabricated frames must then be accordingly drilled to locate the bracket in the left or right position depending on which side of the window the bracket is located. Thus, a two step process is required in which frames must be specially fabricated which can only be used with this specific supporting bracket. If the bracket is mounted such that the vent bar is not offset from the median line of the track, in other words is "in line" with the track, then movement of the hinge at angles to the track becomes difficult, if not impossible. As shown in FIG. 1, the tip of the vent bar tends to bind at the cap member if the vent bar is attempted to be moved in the direction A, caused in part by the vent bar crossing over the centerline of the track member. If movement is at all possible, it must use the compression of the weather-strip rather than the geometry of the cap to allow the window to open. In addition, the ability to laterally offset the vent bar results in insufficient containment of the end of the vent bar in the cap in its home position. The insufficient containment can result in "play" in the home position which can translate into air and water leakage from the weather-strip.

U.S. Pat. Nos. 4,689,852 and 4,718,144 to Buckley disclose an attempt at solving some of the above-described problems. Buckley discloses the use of a friction supported stay having a cap member and nose member sharing a corresponding asymmetrical shape designed to prevent the displacement of the nose from the cap member typical with heavy windows. Although a stay of this design can utilize window tooling for center mount installation, the stay is what is termed "handed", that is, there must be separately designed stays for the left hand side and the right hand side of a window (or top side and bottom side). This inevitably increases the complexity of installation. In addition, the stay of Buckley requires that the nose member be made of a plastics material and be riveted onto the bar. The cap member is also made of a plastics material and riveted onto the track. The application of a separate nose member increases the time to manufacture the stay, and thus increases the cost per stay. In addition, it has been found by some installers that the separately riveted nose member may on occasion become snagged on the cap member if the window is not closed properly.

Thus, there is a need for a supporting bracket or stay which can be used on either side of a window. There is further a need for a supporting bracket or stay which can utilize center mount installation on both sides of a window. There is further a need for a supporting bracket or stay which opens and closes smoothly without binding at the cap member or between the arms of the supporting bracket. There is further a need for a supporting bracket or stay which prevents any sash play. There is further a need for supporting bracket or stay which utilizes the geometry of the hinge to open and close the window rather than depending on the compression of the weather-strip which could create weather strip problems such as rolling over.

SUMMARY OF THE INVENTION

Thus, it is an object of the present invention to provide a supporting bracket for a window which is non-handed.

It is another object of the present invention to provide a supporting bracket for a window which fits existing window tooling for center mount installation.

It is another object of the present invention to provide a supporting bracket for a window which provides dual sided containment of the vent bar to prevent any sash play.

It is a further object of the present invention to provide a supporting bracket for a window which provides a large contact area between the nose of the vent bar and the cap member to provide immediate "pull-in" of the window sash and prevent weather strip problems.

It is a further object of the present invention to provide structure within a supporting bracket for preventing the supporting bracket from binding during an opening operation.

Other objects will in part be obvious and in part appear hereinafter.

In a preferred embodiment of the present invention, a supporting bracket comprises a track for mounting to a frame, the track having a centerline, a vent bar hinged for movement on both sides of the centerline of the track, the vent bar having a centerline parallel and substantially in line with the centerline of the track when the supporting bracket is in a closed position, and structure, during an opening operation, for preventing the vent bar from crossing the centerline of the track in a direction opposite a direction of opening. The supporting bracket of the preferred embodiment is "non-handed", that is, may be utilized on opposite sides of a window.

The structure for preventing the vent bar from crossing the centerline of the track may, in some embodiments, comprise means for engaging an end of the vent bar, such as a pair of stops abutting two sides of the end of the vent bar when the supporting bracket is in a closed position. The pair of stops may be provided in the form of a cap on the track, the cap having a symmetrical pair of camming surfaces. The end of the vent bar is restricted from lateral offset movement when in the closed position by the means for engaging an end of the vent bar.

In one embodiment, the end of the vent bar may be semi-circular and the means for engaging the end of the vent bar may be a section on each camming surface.

In another embodiment, the end of the vent bar may be provided with symmetrical angled sections meeting at a tip. Each camming surface on the cap would preferably then comprise a first straight surface and a second straight surface disposed at a non-zero angle relative to the first straight surface, the means for engaging the end of the vent bar defined by the second straight surface on each camming surface. The second straight surface of each camming surface join to form a central recess. During insertion of the vent bar into the cap, one of the angled sections of the end of the vent bar first contacts a first straight surface in the end cap and then the tip is drawn into the central recess. The connections between the first straight surface and the second straight surface of the camming surfaces of the cap may be rounded.

In yet another embodiment, the track may have a inner track formed therewithin such that the means for preventing the vent bar from crossing the centerline of the track comprises at least two stop points in the inner track. A link in the supporting bracket pivotally connects the vent bar to a slider on the track, and a pin connects the link to the vent bar. The pin preferably extends below the link and is slidable within the inner track. Thus, the pin engages both stop points in the second track when the supporting bracket is in the closed position.

In all of the embodiments, the arms are preferably provided with full radius edges, that is, they are preferably rounded across the entire short sides of their rectangular cross-sections, for preventing any arm-to-arm binding.

The foregoing and other features and advantages of the invention will be more readily understood and fully appreciated from the following detailed description, taken in conjunction with the accompanying drawings.

BRIEF DESCRIPTION OF THE DRAWINGS

With the above and other objects in view, as may appear hereinafter, reference is directed to the accompanying drawing, in which:

FIG. 9A shows a cross section of an element in a prior art window supporting bracket.

FIG. 9B shows a cross-sectional view and FIG. 9C shows a perspective view of an element in the window supporting bracket of the present invention.

DETAILED DESCRIPTION OF THE PREFERRED EMBODIMENT

Figure 2:
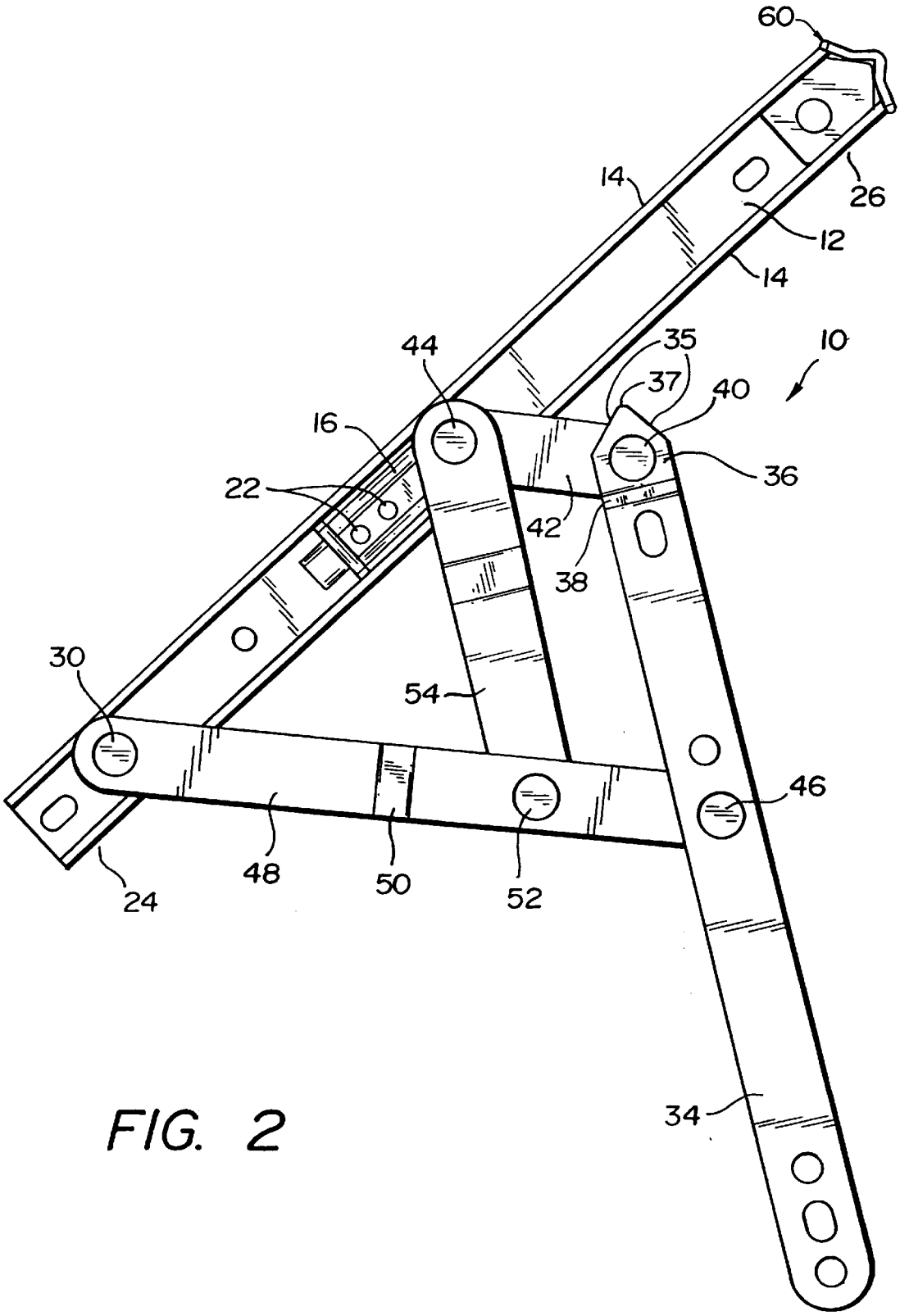
FIG. 2 shows a top plan view of the supporting bracket of the present invention in an open position.

As shown in FIG. 2, a supporting bracket 10 of the present invention may be positioned in one of many open positions. The window sash is frictionally restrained in any angular position to which the supporting bracket 10 is moved. This frictional restraint may be provided partly by the friction at the pivotal connections between the various elements but is largely provided by the frictional engagement between the slider and the track, as will be discussed.

The supporting bracket 10 may be positioned on any side of a window, and is generally provided in pairs. Each bracket 10 in the pair of brackets utilized to support a window includes a track member 12 having folded side flanges 14. The track member 12 is secured by screws to the window frame, not shown, preferably with one end 26 of the track member 12 adjacent a corner of the window frame.

Mounted on the track member 12 is a slide 16 having side flanges 18 which fit under and are retained by the side flanges 14. The slide 16 is preferably a solid brass shoe for smooth, long-lasting performance. The slide 16 is provided with a shallow raised portion forming a cavity confronting the track 12. Mounted within the cavity or raised portion may be a friction adjuster pad 20. The slide 16 may be provided with two or more adjustment screws 22 for maximum friction adjustment.

The slide 16 is slidable between the end 26 of the track member 12, adjacent the corner of a window frame and a position near the opposite or extended end 24. The end 24 of the track remote from the corner of the window frame may be provided with a raised boss (not shown) extending to a level flush with the upper surfaces of the side flanges 14. The boss is provided with a pivot pin or rivet 30. In addition, a washer 32 may be used. The washer 32 is preferably a nylon bearing washer.

Secured to the confronting side of the window sash by screws is a substantially flat vent bar 34. When the window sash is in its closed position within the window frame, the bar 34 overlies or confronts the track 12 with one end 36 adjacent the end 26 of the track 12 disposed in the corner of the window frame. Near this end 36 of the bar 34, there is provided a downward offset 38 and pivot pin or rivet 40.

A short link 42 is pivotally connected between the pivot pin 40 and a pivot pin 44 provided on top of the slide 16.

The bar 34 is provided with a second pivot pin 46. A strut 48 extends between the pivot pin 46 and the pivot pin 30 at the remote end 24 of the track 12. The pivot pin 46 is so located that when the bar 34 is in superposed relation with the track 12, the strut 48 is interposed between the track 12 and bar 34 and is in alignment with the bar 34. This is likewise true of the link 42.

A portion of the strut 48 is offset upwardly as indicated by 50. Within the length of the upwardly offset portion is a pivot pin 52. A brace 54 extends between the pivot pin 52 and the pivot pin 44 of the slide 16. The length of the link 42, between the pivot pins 40 and 44 and the length of the brace 54 between the pivot pins 44 and 52 combined are equal to the portion of the strut 48 between the pivot pins 52 and 46, plus the portion of the bar 34 between the pivot pins 46 and 40. The pivot pins 40, 44, 52, and 46 define a four-sided figure. The bar 34, link 42, strut 48, and brace 54 are preferably all made from stainless steel and are preferably provided with rounded edges, as will be discussed further below for precluding interference of the adjacent hinge elements under load during an opening or closing operation. Together, the four elements 34, 42, 48, and 54 define what is known in the industry as a "four bar hinge". Although only four bars, 34, 42, 48, and 54 are disclosed, it should be understood that additional bars may be included for heavier windows, such as a cross-link connecting the brace 54 to the bar 34.

Figure 3A:
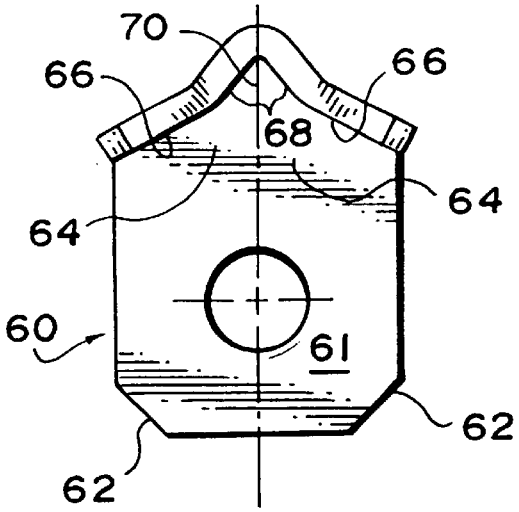
FIG. 3A shows a top plan view of an end cap in one preferred embodiment of the present invention.

It is desirable that the window sash fit tightly against the window frame when the window sash is closed. In a preferred embodiment, this is accomplished by end cap 60, shown in detail in FIG. 3A, secured to the end 26 of the track 12 adjacent the corner of the window frame. The end cap 60 is preferably provided with two tapered comers 62 for easy insertion between the side flanges 14 of the track 12. The end cap 60 is then preferably riveted to the track 12, but may be spot welded or otherwise secured to the track 12. The end cap 60 includes upright angularly related camming surfaces 64. Each camming surface 64 includes a first surface 66. The first surfaces 66 preferably extend at approximately right angles from the base 61. Second surfaces 68 of the camming surface 64 are disposed at non-zero (>180°) angles relative to the first surfaces 66. The non-zero angle is preferably in the range of approximately 190° to 210°, and preferably 203°. The first surfaces 66 are flared outwardly a bit more than necessary to ensure collection of the vent bar end 36. The second surfaces 68 join together, preferably at an acute angle, in the range of approximately 70° to 90°, and preferably 80°, to form a central recess 70.

Figure 3B:
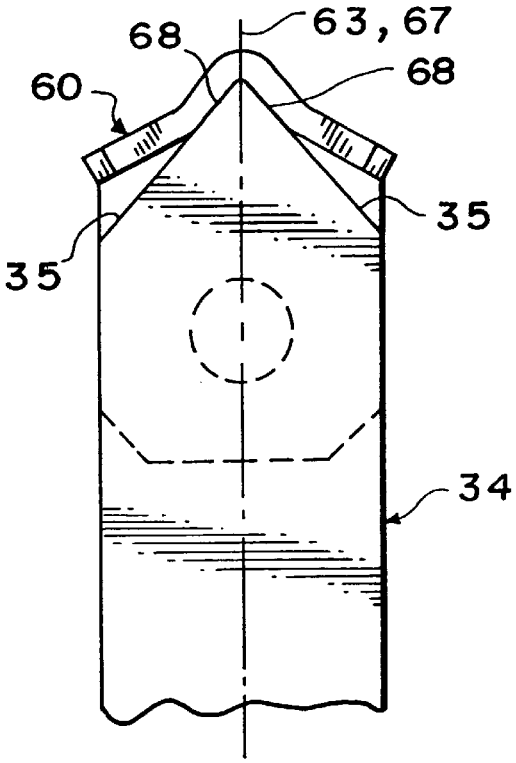
FIG. 3B shows a top plan view of a vent bar in a closed position with respect to the end cap of FIG. 3A.
Figure 3C:
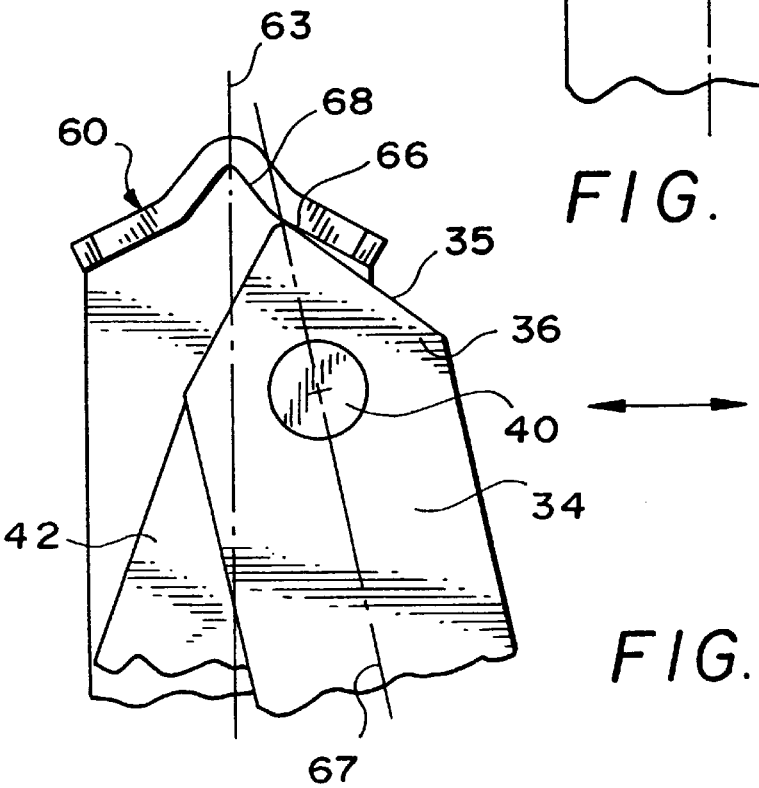
FIG. 3C shows a top plan view of a vent bar in a partially open position with respect to the end cap of FIGS. 3A and 3B.

As shown in FIGS. 2, 3B, and 3C, the end 36 of the bar 34 includes two angled sections 35 leading to a tip 37. As the bar 34 moves into its superposed position relative to the track 12, one of the angled sections 35 engages a corresponding camming surface 64 and draws the sash and window tightly together. The angled section 35 which engages the camming surface 64 first engages the first surface 66, slides along first surface 66 until the other angled section 35 abuts the second surface 68 of the opposite camming surface 64. Then, the end 36 is urged into its home position with the tip 37 nestled between the two second surfaces 68 of the central recess 70.

The geometry of the end cap 60 is such that the end 36 of the vent bar 34 first engages the camming surface 64 with a surface of the angled section 35 rather than with just the tip 37, as shown in FIG. 3C. This large contact area allows for immediate "pull-in" of sash to prevent weather strip problems.

As shown in FIG. 3B, when the end 36 is collected within the central recess 70, the second surfaces 68 provide a dual sided containment area for the vent bar 34 which prevents any sash play. That is, with the end 36 contacted on both angled sections 35 by the end cap 60, the end 36 is prohibited from jiggling within the end cap 60 which could otherwise result in air and water leakage in the weather-strip. Also as shown in FIG. 3B, the centerline 67 of the vent bar 34 is in line with the centerline 63 of the track 12 when the supporting bracket is in a closed position. From this closed position, the supporting bracket may be moved in either the A or B direction without binding. Thus, the supporting bracket may be mounted on any side of a window.

Figure 1:
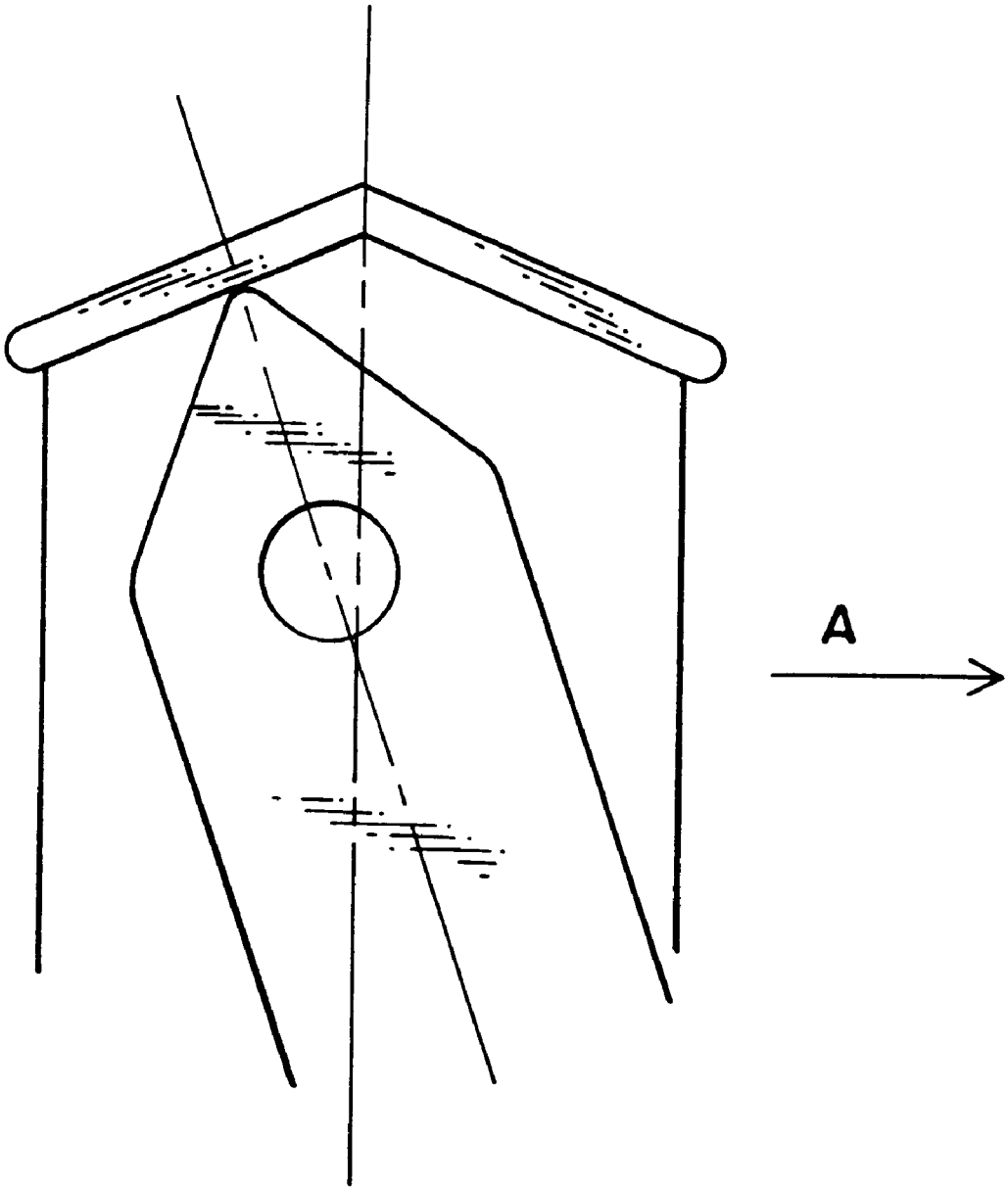
FIG. 1 (PRIOR ART)
FIG. 1 shows a top plan view of a prior art end cap and vent bar of a supporting bracket for windows.

The end cap of the present invention also allows for easy opening of windows without the binding experienced in prior art supporting brackets, such as that shown in FIG. 1. When the supporting bracket is opened, the reverse of a closing scenario described above is realized. First, one of the surfaces of the angled section 35 abuts one of the second surfaces 68. Then, the other angled section 35 abuts an opposite first surface 66 (that is, a first surface from the other camming surface 64). The hinge elements then move freely out of the end cap and assume the desired open configuration.

Binding, or obstruction to an opening operation, is prevented from occurring in the present invention in part because the link 42 rotates only in the direction of opening. Binding occurs when the link 42 begins to rotate in a direction opposite to the direction of opening. For example, when the bar 34 is opened to the right as shown in FIG. 2, link 42 moves only in a rightward direction in the present invention. If the offsetable vent bar of the prior art supporting bracket is not properly offset, then the link moves in a direction opposite the direction of opening as soon as the vent bar is moved in an opening direction. Thus, the prior art supporting bracket must be correctly mounted to prevent binding, and therefore cannot take advantage of center mount installation.

The present invention utilizes substantially immediate contact between the end 36 of the vent bar 34 and the end cap 60 during opening on a side opposite the direction of opening to ensure that the link 42 moves only in the direction of opening. For example, in the embodiment described above, when the supporting bracket 10 is to move to the right from a closed position, the left angled section 35 first abuts the left second surface 68. Thus, the link 42 is prevented from moving leftward. As the vent bar 34 is pulled further to the right, the right angled section 35 then slides towards and along the right first surface 66. During this motion, the link 42 begins to move in a rightward direction, and continues to move in the right direction as the supporting bracket is opened to the right. Likewise, once the vent bar 34 begins the opening operation, it never crosses the centerline 63 of the track 12 in a direction opposite the direction of opening. Thus, it can be seen that the present invention utilizes a "stop" to immediately contact a side of the vent bar end opposite the side facing the direction of opening, that "stop" serving to prevent the link 42 from moving opposite the direction of opening.

Figure 4:
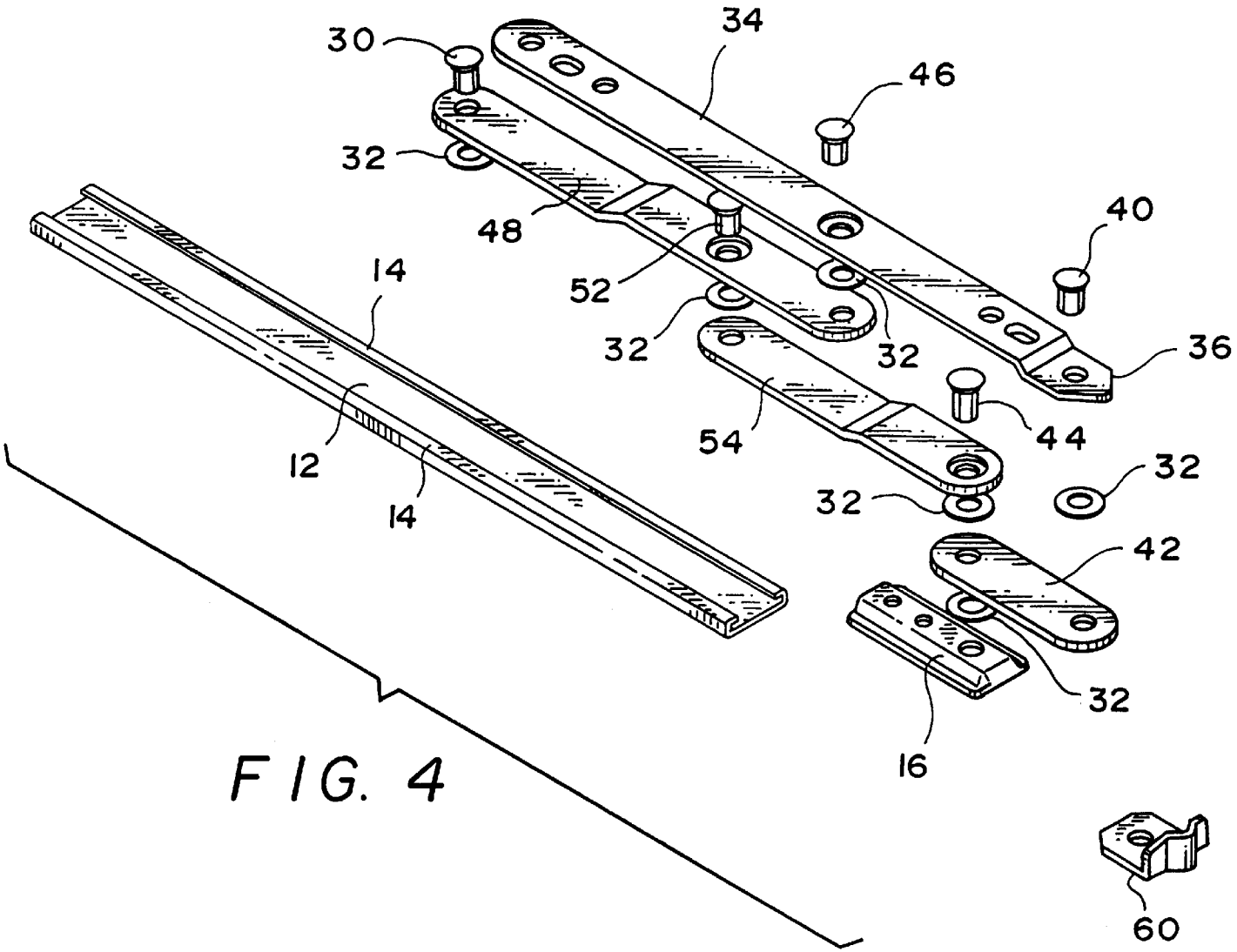
FIG. 4 shows an exploded side perspective view of the elements used in assembling the supporting bracket of FIG. 2.
Figure 5A:
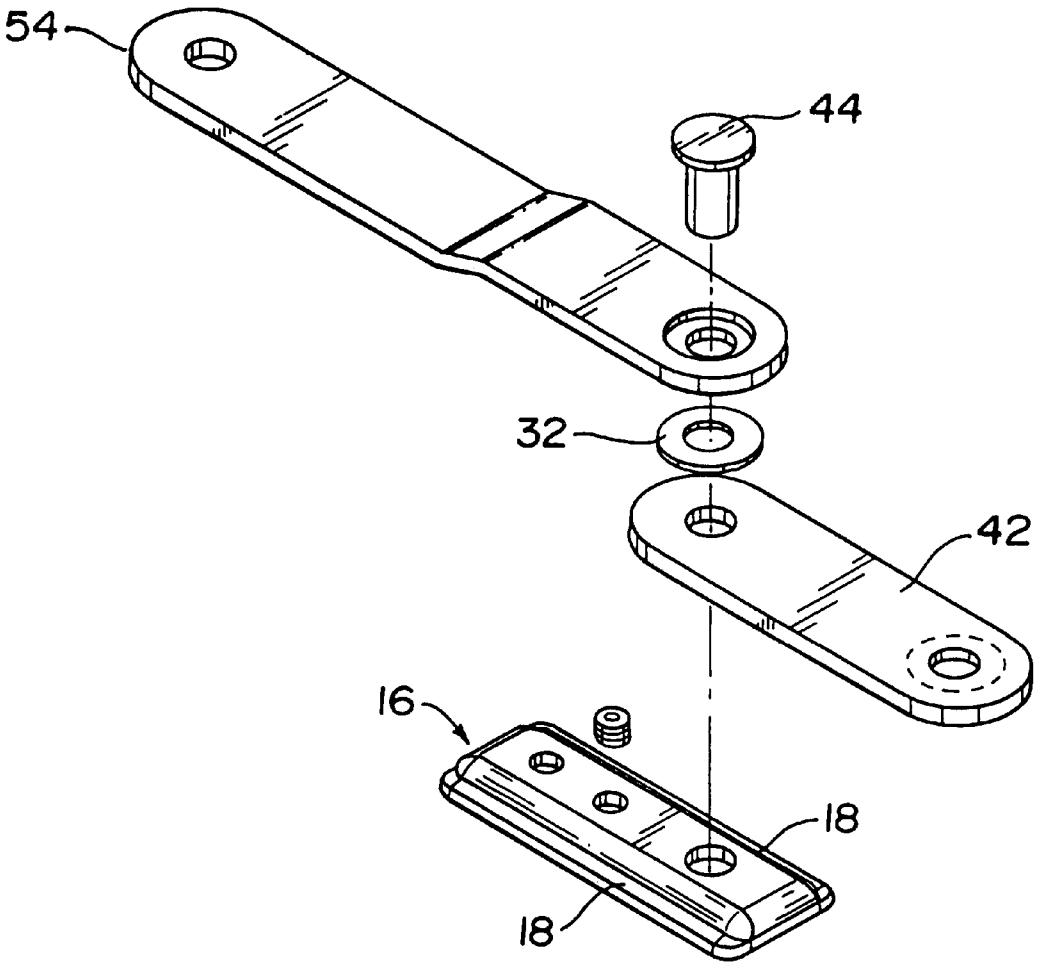
FIGS. 5A–5C show exploded side perspective views of one method for assembling the elements of FIG. 4 into the supporting bracket of FIG. 2.
Figure 5B:
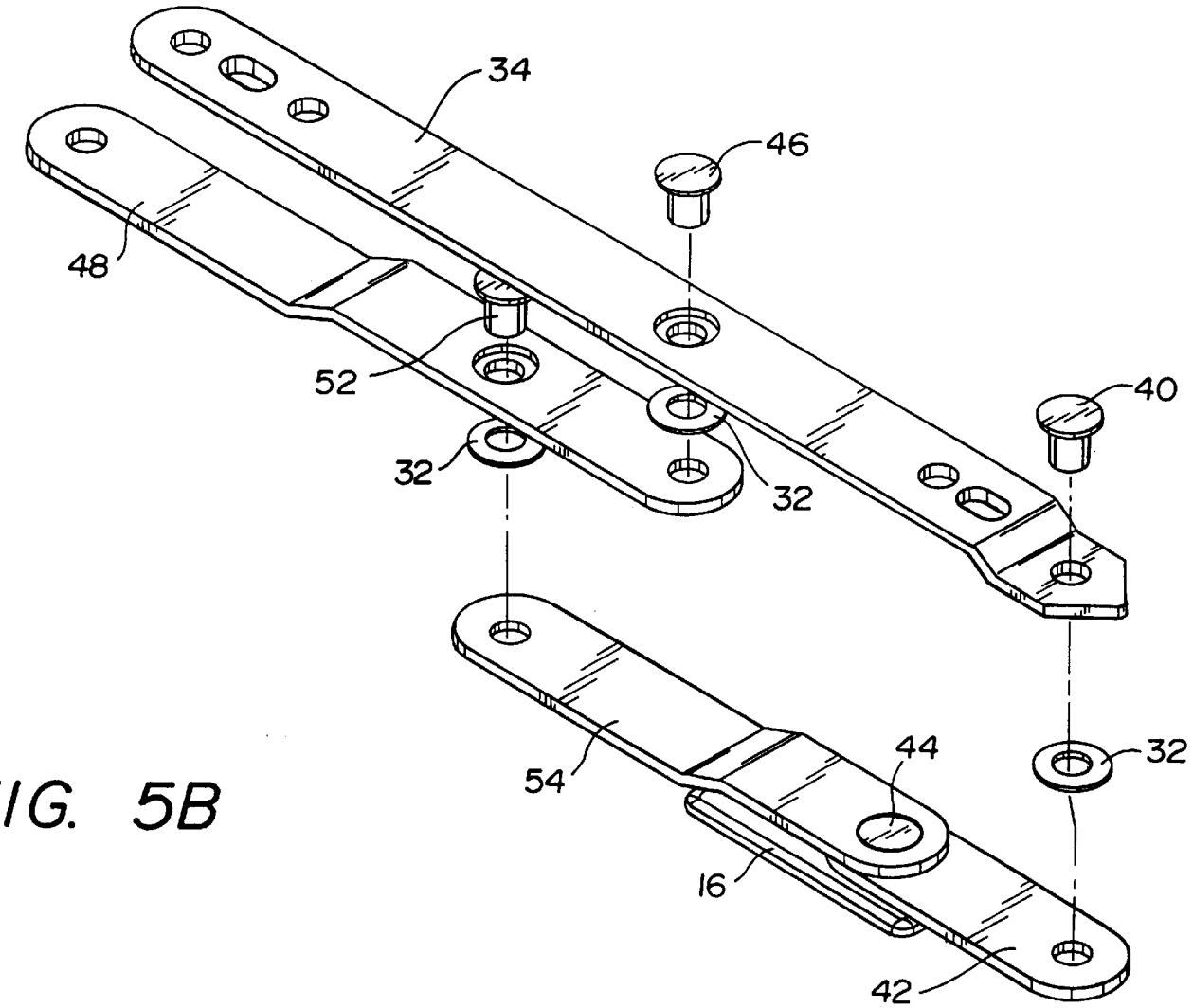
Figure 5C:
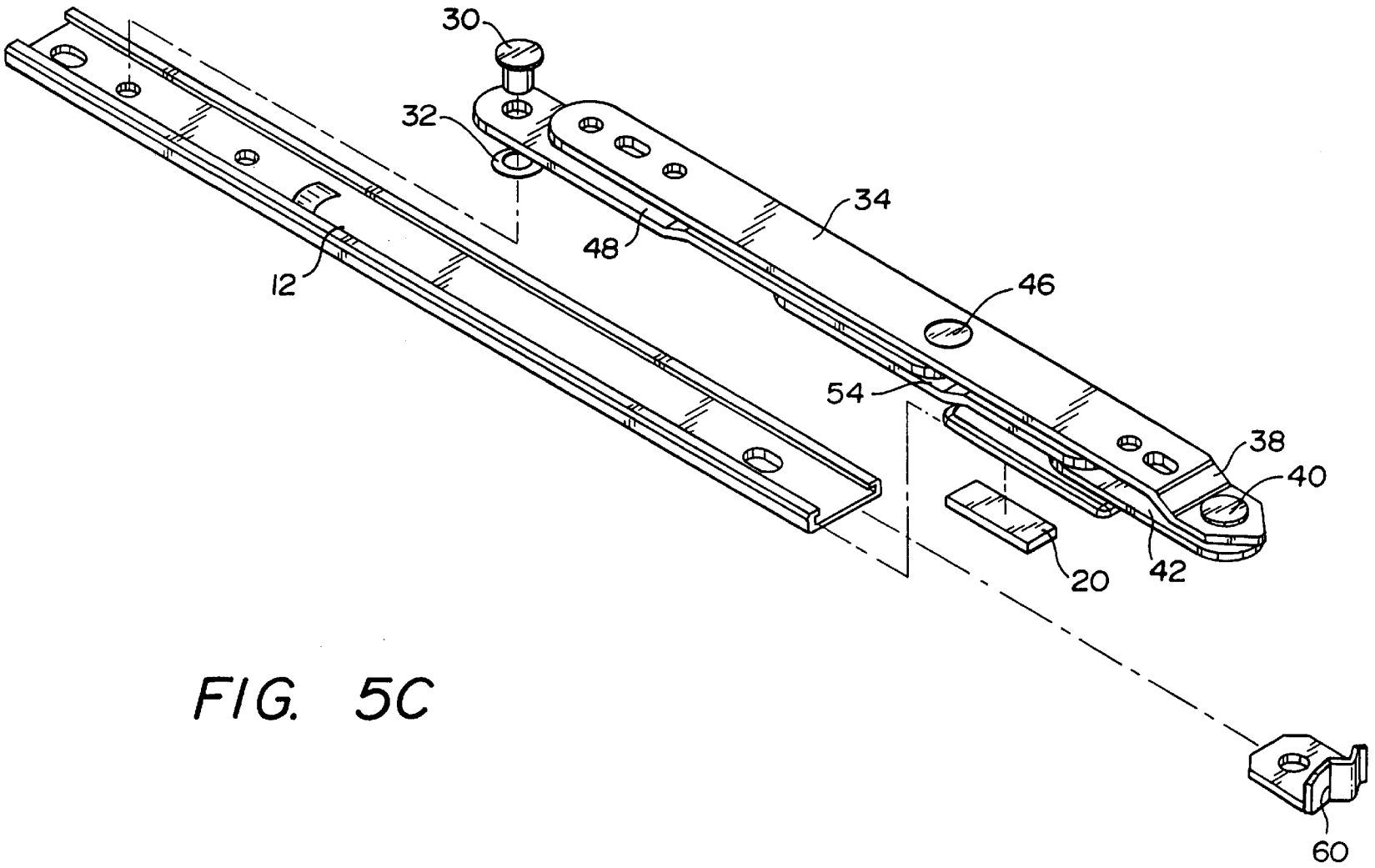
Figure 5D:
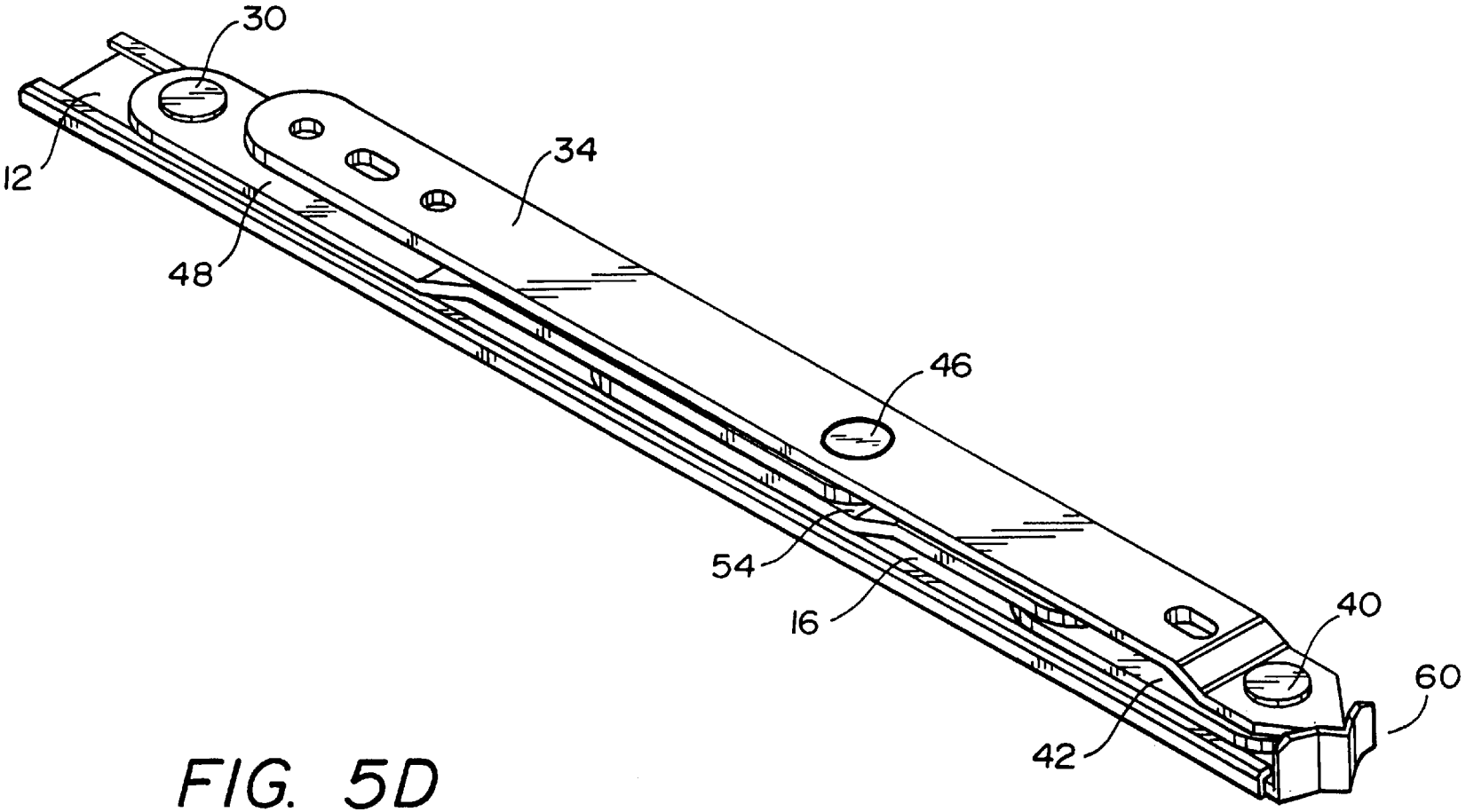
FIG. 5D shows a side perspective view of a fully assembled supporting bracket.

In assembling the supporting bracket of the present invention, the parts shown in FIG. 4 are preferably used. For smooth operation, it is preferred that nylon washers 32 are employed at all pivot points. These washers 32 could, in some less expensive embodiments, be omitted. In one possible method of assembly, the brace 54 may first be secured to the link 42 and the slide 16 using rivet 44, as shown in FIG. 5A. Turning to FIG. 5B, the strut 48 may be connected to the bar 34 with rivet 46, and then the strut 48 may be secured to the brace 54 with rivet 52 while the bar 34 is connected to the link 42 with rivet 40. As shown in FIG. 5C, the friction adjuster 20 may be aligned below the cavity of the slide 16 and the four bar hinge 34, 42, 48, 54 may be riveted to the track 12 while the slide 16 is disposed within the side flanges 14 of the track 12. Then, the end cap 60 may be installed at the end 26 of the track 12. FIG. 5D shows the completely assembled supporting bracket of the present invention.

The end cap 60 of the present invention may be manufactured in one of two ways. Preferably, a mold/stamping die is prepared for forming the end cap 60 with the appropriate dimensions. Alternatively, an end cap with two straight camming surfaces may be dropped in a nest and crimped to form the first and second surfaces. This, however, would require a second operation.

As previously discussed, the present invention enables a single supporting bracket to be utilized on both the left and right sides of a window while utilizing existing central mount installation window tooling. The embodiment of the end cap 60 shown in FIG. 3A achieves these objectives by providing two separate contact areas for guiding an end of a vent bar into an end cap. It also utilizes two separate contact areas for providing dual sided containment of the end of the vent bar to prevent sash play. The immediate contact between the end cap and the end of the vent bar on a side opposite the direction of opening prevents the link from rotating in a direction opposite the direction of opening and thus prevents binding by preventing the vent bar from moving past the centerline during opening. Thus, the second surface opposite the direction of opening acts as a "stop" to prevent binding.

Figure 6:
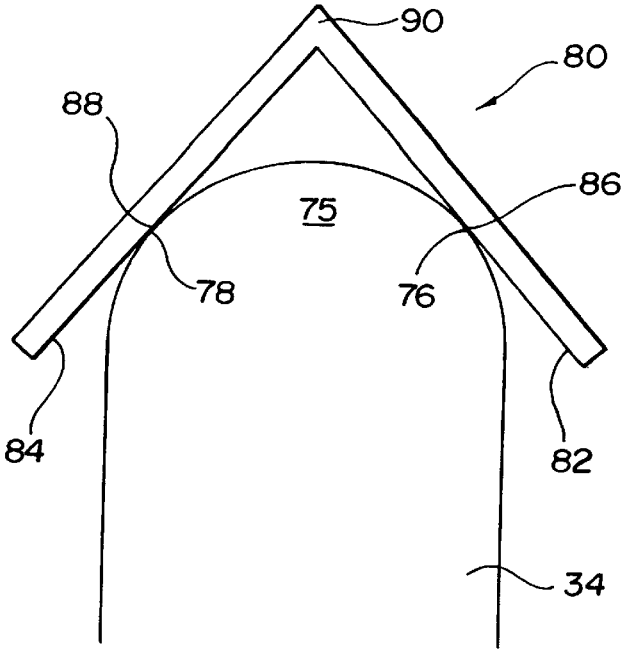
FIG. 6 shows a top plan view of another embodiment of a vent bar end/cap combination for a supporting bracket of the present invention.

Alternate "stops" for preventing the link of the supporting bracket 10 from rotating in a direction opposite the direction of opening are within the scope of the present invention. For example, a second embodiment of an end cap/vent bar end combination is shown in FIG. 6. In this embodiment, the end cap 80 is a straight sided end cap with first side 82 and second side 84 joining at junction 90. The vent bar 34 is provided with a symmetric semi-circular shaped nose 75. In all other respects, the vent bar 34 is identical to the vent bar 34 described with respect to FIG. 2. When the vent bar 34 is pushed towards the end cap 80 in a leftward closing direction, arc 78 first abuts with second side 84. As the vent bar 34 is straightened out with respect to the track 12, the arc 76 then abuts first side 82. When the vent bar 34 comes to a rest, i.e. is parallel and in line with the track 12, the arc 76 abuts section 86 on first side 82 and arc 78 abuts section 88 on second side 84. Thus, when it is desired to open the supporting bracket back in the rightward direction, virtually immediate contact is provided between the arc 78 on the left side of the vent bar end 75 and section 88 of the left side 84. This immediate contact serves as a stop to prevent the link 42 from moving in a leftward direction. Instead, the arc 76 slides along the section 86 as the vent bar 34, and correspondingly the link 42, are moved rightwardly.

Figure 7A:
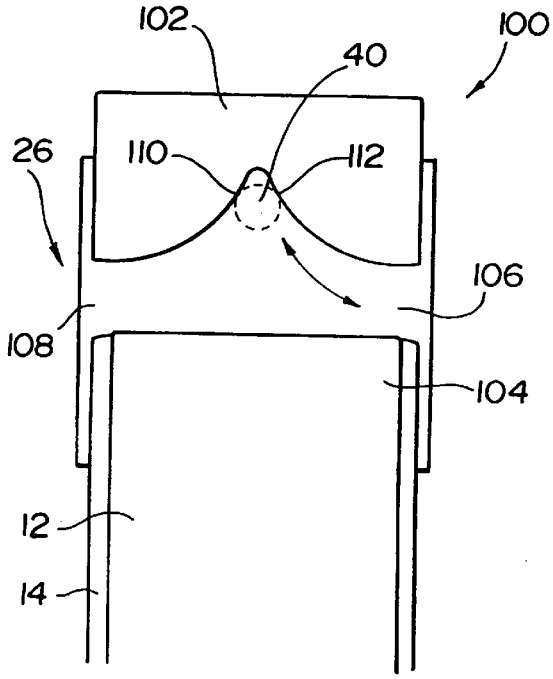
FIG. 7A shows a top plan view of a track member in accordance with another embodiment of a supporting bracket of the present invention and FIG. 7B shows a bottom plan view of a pin, link, and vent bar for use with the embodiment of FIG. 7A.
Figure 7B:
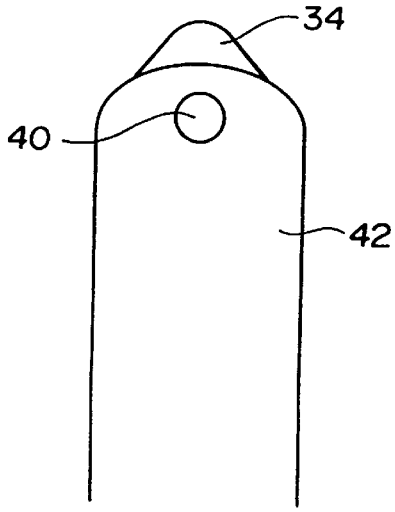

While the embodiments described above utilize end caps, it would be possible to eliminate the end caps completely and still maintain the dual sided contact of the end of a vent bar in a central mounted in-line supporting bracket. FIG. 7A shows an embodiment 100 in which the end 26 of the track 12 comprises a first section 102 separated from a second section 104 by a track 106. In this embodiment, the track 106 is created by a member 108 connecting the first 102 and second 104 sections together, although it is within the scope of this invention to include alternate methods of forming tracks within the end 26 of the track 12. The track is engaged by a circular pin extending from the rear of the link 42, as shown in FIG. 7B. The pin may be an extension of the rivet 40 used in the supporting bracket 10 to connect the vent bar 34 to the link 42. When the vent bar 34 is pushed towards the track 12 into a closing position, the pin 40 enters the track 106. When the vent bar 34 is in-line with the track 12, the pin 40 engages the track 12 on at least two points 110 and 112. Thus, when the supporting bracket is moved back into an open position, say in a rightward direction, the pin 40 abuts the left contact 110 to prevent movement of the link 42 in a leftward direction, allowing the vent bar 34 to move rightwardly. Although the link 42 is shown with a rounded end and the vent bar 34 is shown with a pointed end in FIG. 7B, the shapes of the ends are irrelevant to the function of this embodiment.

Figure 8A:
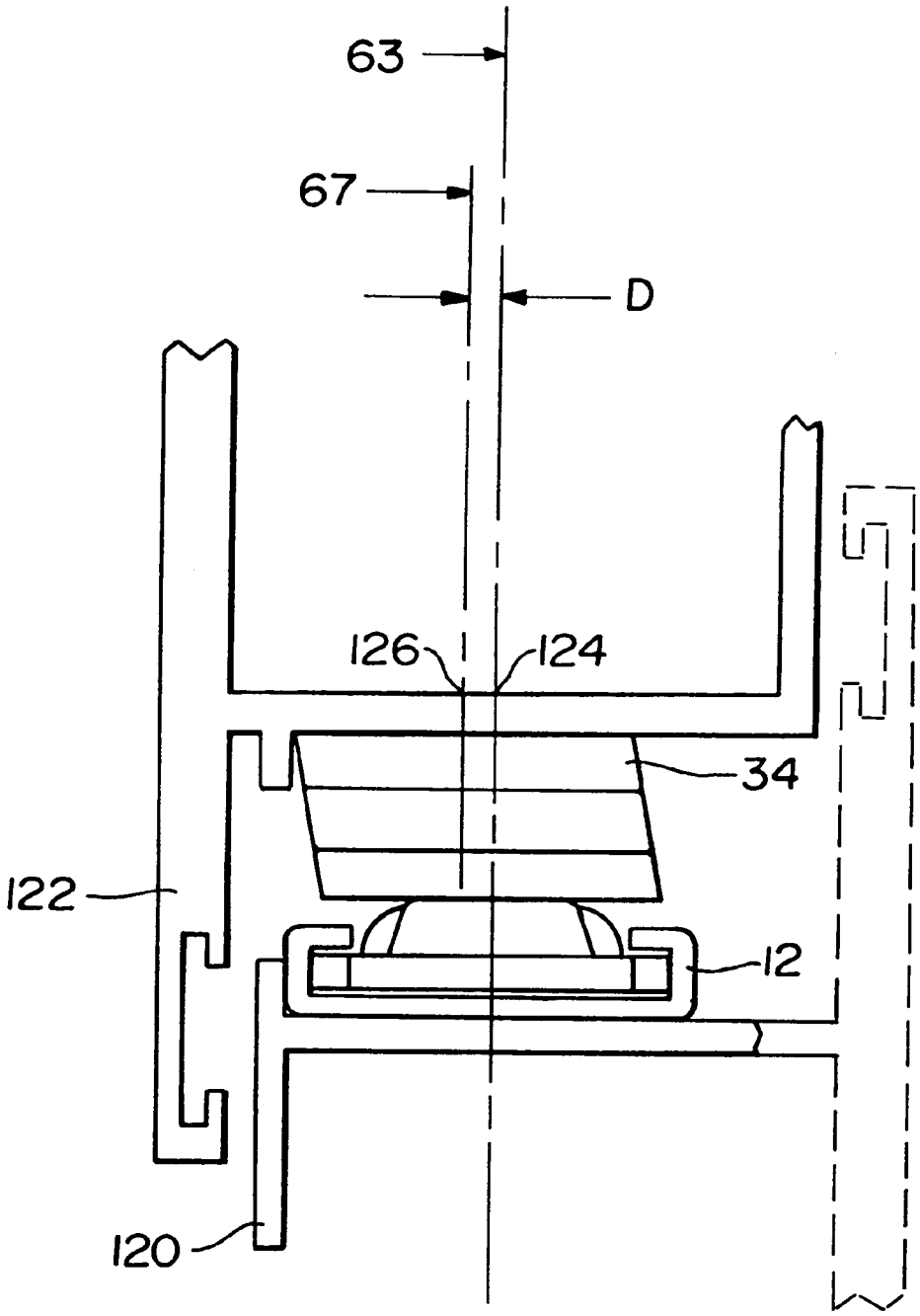
FIG. 8A (PRIOR ART)
FIG. 8A shows a cross-sectional view of the mounting set-up of a window supporting bracket of the prior art and FIG. 8B shows a cross-sectional view of the mounting set-up of a window supporting bracket of the present invention.

FIG. 8A shows how a prior art hinge, such as the hinge of Anderberg et al, must be mounted between a window frame 120 and sash 122. The centerline 67 of the vent bar 34 must be offset from the centerline 63 of the track 12 by a distance D, which may be 70/1,000 of an inch. Thus, holes must be drilled at a location 126 in the sash 122, which is offset the distance D from where a central mount installation location 124 would be. On the other side of the sash 122 (not shown), holes must be drilled at a location a distance D in the other direction of the centerline 63. Thus, the prior art window supporting bracket must be utilized with a window drilled according to precise specifications, and must be mounted with the same offset distance on both sides of the window.

Figure 8B:
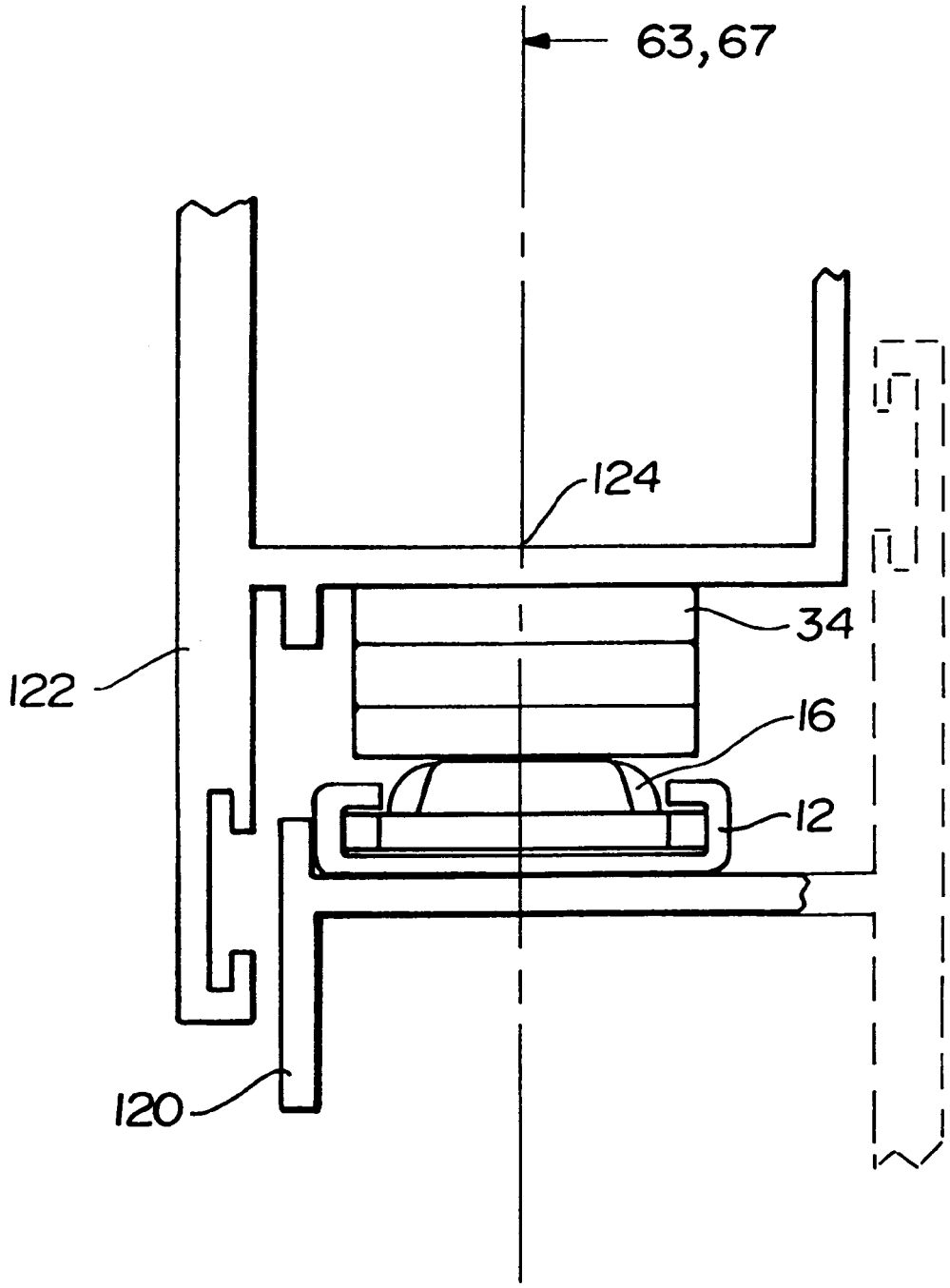

As shown in FIG. 8B, the present invention may be advantageously mounted such that holes need only be drilled at the location 124, on both sides of the window sash 122, in line with the centerline 63 of the track 12, which is in-line with the centerline 67 of the vent bar 34. Thus, windows drilled for central mount installation may be used with the non-handed window supporting bracket of the present invention, wherein such windows have previously only been used with "handed" window supporting brackets.

As previously discussed, the bar 34, link 42, strut 48, and brace 54 are preferably all made from stainless steel and are preferably provided with rounded edges for precluding interference of the adjacent hinge elements under load during an opening or closing operation. The various elements of the prior art, shown collectively as item 130 in FIG. 9A, have a rectangular cross-section with substantially right angled corners 132 which are just "deburred" for removing the burrs from the corners after the elements are cut from stock. The elements 130 assembled together into a window supporting bracket should function adequately under light loads. However, if the window sash is extremely heavy, or if the elements are otherwise pushed together tightly, it becomes more difficult for adjacent elements 130 to pass over each other without interference. FIGS. 9B and 9C show the elements 34, 42, 48, and 54, collectively as item 140 having edges 142 which are rounded across the entire edge, rather than just at comers. Thus, when adjacent elements 140 pass over one another, even under heavy loads, interference experienced is minimal because even if edges 142 abut one another, they are still able to push past each other without difficulty. The full radius-edged arms prevent any arm to arm binding. When the items 140 are cut from stock, they are preferably milled to form the rounded edges 142. Because the deburring of elements 130 of the prior art requires a secondary operation after cutting from stock, rounding the edges from the elements 140 does not increase the time or cost of manufacturing.

Thus, it is apparent that there has been provided, in accordance with the invention, a supporting bracket that fully satisfies the objects and advantages set forth above. The supporting bracket is non-handed while at the same time can be mounted using center mount installation. In addition, the improved supporting bracket provides a large contact area for the end of the vent bar allowing for immediate collection of the vent bar end and pull-in of sash to prevent weather strip problems. The dual-sided containment of the vent bar prevents any sash play which could result in air and water leakage in the weather strip. While the invention has been described in conjunction with specific embodiments thereof, it is evident that many alternatives, modifications, and variations will be apparent to those skilled in the art in light of the foregoing description. Accordingly, the present invention is intended to embrace all such alternatives, modifications, and variations as fall within the spirit and broad scope of the appended claims.

What is claimed is:

1. A non-handed in-line supporting bracket comprising:

a track adapted for mounting to a frame, the track having a centerline;

a vent bar hingedly connected to the track for movement to an open position on either side of the centerline of the track, the vent bar having a centerline parallel and substantially in line with the centerline of the track when the supporting bracket is in a closed position; and, means, during an opening operation, for preventing the centerline of the vent bar from crossing the centerline of the track in a direction opposite a direction of opening.

2. The supporting bracket of claim 1 wherein the means for preventing the centerline of the vent bar from crossing the centerline of the track comprises means for engaging an end of the vent bar.

3. The supporting bracket of claim 2 wherein the means for engaging an end of the vent bar comprises a pair of stops abutting two sides of the end of the vent bar when the supporting bracket is in a closed position.

4. The supporting bracket of claim 2 wherein the means for preventing the centerline of the vent bar from crossing the centerline of the track comprises a cap on the track, the cap having a symmetrical pair of camming surfaces.

5. The supporting bracket of claim 4 wherein the end of the vent bar is semi-circular and the means for engaging the end of the vent bar is a section on each camming surface.

6. The supporting bracket of claim 4 wherein the end of the vent bar is provided with symmetrical angled sections meeting at a tip, each camming surface comprises a first straight surface and a second straight surface disposed at a non-zero angle relative to the first straight surface, and the means for engaging the end of the vent bar comprises the second straight surface on each camming surface.

7. The supporting bracket of claim 6 wherein connections between the first straight surface and the second straight surface of the camming surfaces of the cap are rounded.

8. The supporting bracket of claim 6 wherein the second straight surface of each camming surface join to form a central recess.

9. The supporting bracket of claim 6 wherein, during insertion of the vent bar into the cap, one of the angled sections of the end of the vent bar first contacts one of the camming surfaces of the end cap and then the tip is drawn into the central recess.

10. The supporting bracket of claim 9 wherein the angled section first contacts the first straight surface.

11. The supporting bracket of claim 2 wherein the end of the vent bar is restricted from lateral offset movement when in the closed position by the means for engaging an end of the vent bar.

12. The supporting bracket of claim 1 wherein the track is a first track, the supporting bracket further comprising a second track formed within the first track, the means for preventing the centerline of the vent bar from crossing the centerline of the track comprising at least two stop points in the second track.

13. The supporting bracket of claim 12 further comprising a link pivotally connecting the vent bar to a slider on the first track, the link having an upper surface facing the vent bar and a lower surface facing the first track, the slider, and the second track, and a pin connecting the link to the vent bar, the pin extending beyond the lower surface of the link and slidable within the second track, wherein the pin engages both stop points in the second track when the supporting bracket is in the closed position.

14. A supporting bracket comprising:

a track having a centerline;

a slider movable along the track;

a strut pivotally connected to the track;

a brace pivotally connected between the slider and the strut;

a link pivotally connected to the slider;

an end cap disposed on one end of said track, wherein said end cap comprises means for preventing said link from moving in a direction opposite a direction of opening: and a vent bar pivotally connected to the link and to the strut to extend there between, the vent bar having a symmetrical end portion remote from the strut, said bar operatively coupled so that as said slider moves along said track said bar swings between a closed position overlying said track, with a centerline of said vent bar maintained in line with the centerline of said track by said end cap, to an open position angled with respect to said track;

wherein cross-sections of the strut, brace, link, and vent bar are generally rectangular with short sides of the generally rectangular cross-sections defined by fully rounded edges for preventing binding between adjacent elements during an opening or closing operation.

15. The supporting bracket of claim 14 wherein said end cap comprises a pair of joined internal surfaces engageable by external surfaces of said end portion of said vent bar, wherein said means for preventing said link from moving in a direction opposite a direction of opening comprises a stop section on each internal surface of said end cap.

16. The supporting bracket of claim 15 wherein each internal surface of said end cap comprises a first surface and a second surface disposed at a non-zero angle relative to the first surface, the second surfaces joining to form a central recess in the end cap, wherein each stop section is located on a second surface.

17. The supporting bracket of claim 16 wherein the symmetrical end portion of the vent bar comprises a right angled section and a left angled section joining at a point, wherein, during one closing operation, the right angled section first contacts a first surface of a right internal surface, then a left angled section contacts a second surface of a left internal surface.

18. The supporting bracket of claim 14 wherein the end cap prevents jiggling of the vent bar in the closed position by simultaneously contacting a left side of the end of the vent bar with a left side of the end cap and a right side of the end of the vent bar with a right side of the end cap.

19. A symmetrical end cap for a non-handed in-line four bar hinge comprising:

a base section engageable with a track;

a first right hand surface extending substantially perpendicularly from said base section;

a second right hand surface extending from said base section and disposed at an angle between approximately 190° and 210° relative to said first right hand surface;

a first left hand surface extending substantially perpendicularly from said base section;

a second left hand surface extending from said base section and disposed at an angle between approximately 190° and 210° relative to said first left hand surface; and, a central recess formed by the joining of the second right hand surface and the second left hand surface, the central recess having an angle between approximately 70° to 90°.

20. The symmetrical end cap of claim 19 wherein the base section has tapered end portions for easy insertion into side flanges of a track.

21. A method of utilizing an in-line non-handed hinge, the hinge having a vent bar hingedly connected to a track and an end cap attached to the track the vent bar movable to both a right handed open position and a left handed open position, the method comprising the steps of:

a) simultaneously abutting a left hand side and a right hand side of an end of the vent bar with a left hand side and a right hand side, respectively of a recess in the end cap to prevent the vent bar from jiggling in a closed position:

b) moving a portion of the vent bar to a right handed open direction;

c) simultaneous to the step of moving a portion of the vent bar to a right handed open direction, contacting the left hand side of the end of the vent bar with the left hand side of the recess in the end cap to preclude any movement of the vent bar in a left handed open direction; and, d) moving the vent bar to the right handed open position.

* * * * *